United States Patent [19]

Fladung

[11] Patent Number: 4,775,261

[45] Date of Patent: Oct. 4, 1988

[54] BARRIER DEVICE FOR THE TEMPORARY BLOCKING OF A ROADWAY

[75] Inventor: Manfred Fladung, Mömbris, Fed. Rep. of Germany

[73] Assignee: Manfred Fladung GmbH, Mombris, Fed. Rep. of Germany

[21] Appl. No.: 943,640

[22] Filed: Dec. 18, 1986

[30] Foreign Application Priority Data

Dec. 20, 1985 [DE] Fed. Rep. of Germany ..... 3545507
Oct. 29, 1986 [DE] Fed. Rep. of Germany ... 8628876[U]

[51] Int. Cl.[4] ..... E01F 13/00

[52] U.S. Cl. ..... 404/6; 49/33; 49/49; 49/131

[58] Field of Search ..... 404/6, 9–11; 49/33, 49, 131

[56] References Cited

U.S. PATENT DOCUMENTS

| | | | |
|---|---|---|---|
| 1,203,006 | 10/1916 | Keenan | 404/6 |
| 1,356,922 | 10/1920 | Keenan | 49/33 |
| 1,365,165 | 1/1921 | Garcia | 49/33 |
| 1,497,073 | 6/1924 | Doyle | 404/6 X |
| 1,579,125 | 3/1926 | Marshall et al. | 49/131 X |
| 3,805,448 | 4/1974 | Carr et al. | 49/49 |
| 4,490,068 | 12/1984 | Dickinson | 404/6 |
| 4,577,991 | 3/1986 | Rolow | 404/6 |

FOREIGN PATENT DOCUMENTS

| | | | |
|---|---|---|---|
| 2930091 | 2/1981 | Fed. Rep. of Germany | 404/6 |
| 8203450 | 4/1984 | Netherlands | 404/6 |

*Primary Examiner*—Jerome Massie
*Assistant Examiner*—John F. Letchford
*Attorney, Agent, or Firm*—Jordan B. Bierman

[57] ABSTRACT

A vehicle barrier device 10 for the temporary blocking of a roadway 12 comprises blocking elements 20, 22, 24, 25 with joined conter-elements 26, 28, 30, 31. The blocking elements 20, 22, 24, 25 are pivotable around axles extending parallel to the main direction of the roadway 12 and are arranged either in the main flush with the roadway 12 or can be swung out of it. The barrier elements 20, 22, 24, 25 are inserted exchangeably into a frame 132 which is set into a pit 128 present in the roadway 12.

20 Claims, 5 Drawing Sheets

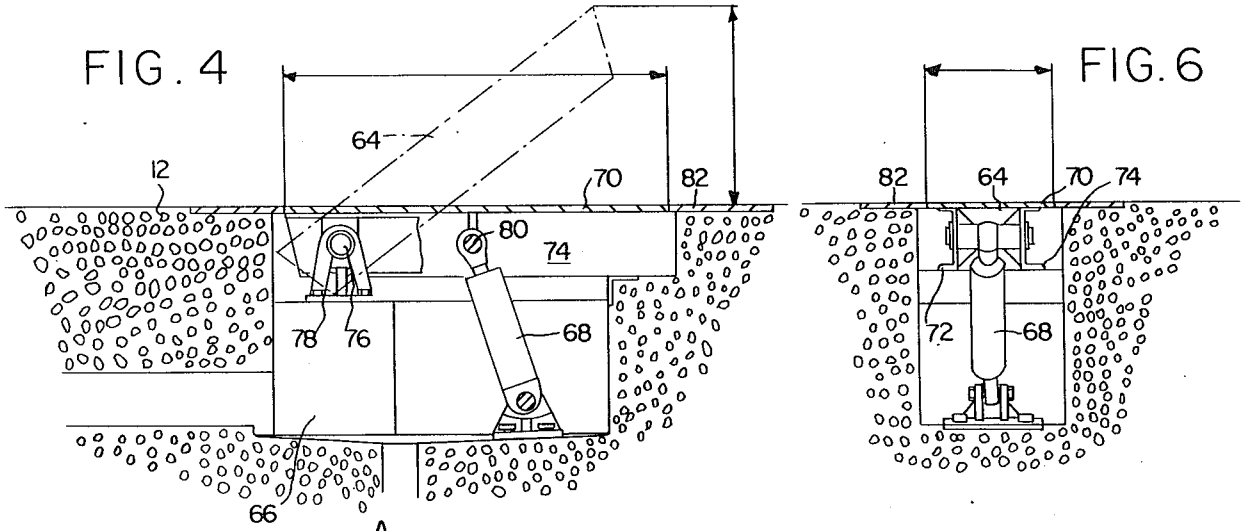
FIG. 4
FIG. 6
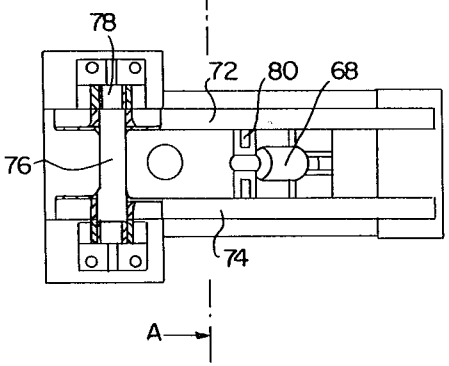
FIG. 5

BARRIER DEVICE FOR THE TEMPORARY BLOCKING OF A ROADWAY

BACKGROUND OF THE INVENTION

The invention relates to a barrier device for the temporary blocking of a roadway or such, comprising barrier elements which by choice can be either in the main arranged flush with the surface of the roadway or can be swung out of it, whereby each barrier element is pivotable around an axle running in the main parallel to the main highway direction, said barrier element being joined to a counter-element present below or in the main below the roadway surface.

Corresponding traffic barriers for the temporary blocking of free highways can comprise prism-shaped barriers extending along the breadth of the highway and which can be swung out of the highway in order to protect grounds in need of protection—e.g. public or private supply centres or power installations—against illegal or violent entry by motor vehicles or bicycles. Said barriers, which can also be termed blocking elements, are very large, maintenance intensive and when hit by a vehicle are fundamentally no longer in working order, i.e. the blocking element can no longer be sunk into the roadway. In the case of a disaster this results however in the area which is to be protected being blocked off, which is to be avoided at all costs.

SUMMARY OF THE INVENTION

An aim of the present invention is to design a barrier device as previously described, so that with minimum measuring of the simple blocking elements it is ensured that illegal driving on the roadway—regardless as to from which direction—can be prevented, whereby with regard to the construction and consequently functionability, a high degrees of reliability and ease of maintenance should be guaranteed.

A further object of the invention is that the blocking element should only render a vehicle incapable of being driven when it has hit the barrier element, without the life of the driver being endangered.

Finally in the case of maintenance and/or damage to the barrier device, it must be ensured thatthe roadway can still be driven on without any problems.

In accordance with the invention the object is on the one hand solved in that the elements are posts, which, when they are in the main flush with the roadway surface, overlap and lie on each other above the axle. Here the pivot axle extends preferably in the counter-element, preferably in the area of the centre of gravity of the element and counter-element, so that little force is necessary to permit pivoting. In order to enable trouble-free pivoting of the elements, the said elements combine with a rod which is operated by a drive element such as a hydraulic cylinder, which is preferably coupled in the area of the counter-elements. Here the control of the hydraulic cylinder is so arranged that an energy store also guarantees that the barrier elements can be operated during an electricity cut, since only a 24V battery is for example necessary for the control itself. Apart from this as an alternative a hand pump can be provided to lower the barrier elements in an emergency, i.e. to pivot them on the axle extending parallel to the longitudinal direction of the highway.

The sections of the barrier elements lying on top of each other, i.e. the overlapping areas, are formed by recesses—which complete each other in a complementary fashion—of the post elements allocated to each other, whereby the recesses themselves are preferably of a graduated shape. Through supporting the posts in the area above the pivot axle it is possible to achieve optimal reduction of weight, from the point of view of the roadway, so that additional construction measures are not necessary to support the barrier elements when they are flush with the roadway surface.

The barrier elements themselves, and preferably also the counter-elements, consist of double-T girders with an edge length of 300 mm for example, whereby at least the flanges of the barrier elements are joined with flat bars and between these and the rails have reinforcing ribs. The height of the posts above the highway is preferably 650 mm, which ensures that the axles of vehicles hitting the barrier elements are damaged to such an extent that they are unable to drive away independantly. Posts of such a design withstand forces of 100 tons at a speed of 30 km per hour.

The surfaces of the barrier elements, over which vehicles will drive when the elements are in their aligned or flush position, may advantageously be ridged or of checkered plate.

At least the blocking element has an acute-angled rectangular form, whereby the free end is equipped with a rectangular-shaped recess to form a tooth.

According to an independant proposal of the invention the blocking elements, together with the rod, can be set as a unit in a frame and are interchangeable, whereby the frame is equipped with a dead mould, which can be inserted in a pit present in the highway, whereby preferably the motor driving the rod can be inserted into the frame interchangeably together with the unit.

By means of such a design the fitting of the barrier device is completely trouble-free. A pit has only to be excavated out of the roadway and the ground to be cast with a cement floor in order to fit the frame with the dead mould, which consists of sheet metal. This is then cemented, which guarantees a high degree of accuracy. Finally, as a unit, the barrier elements held by a supporting construction (assembly unit) can be fitted with the counter-elements as well as the rods and drive equipment, and for example in the case of maintenance work can be removed again as a unit. The frame only has to be then covered with a ramp which can be driven over, and then the roadway is clear even during maintenance work.

The underground supporting construction (assembly unit) containing the elements in a pivotable fashion is hot-dip galvanised and is statically equipped in accordance with the strains to be expected.

All rotating parts are provided with lubricating devices, whereby the bearings themselves are manufactured from high-quality bearing material in order to guarantee a high degree of efficiency even with extreme strain.

With regard to the pivoted barrier elements it must be said that in a position pivoted out of the roadway surface at an angle of 90° they interact with a dead stop to limit the pivoting process. In the opposite direction an uncontrolled swinging back is blocked by the operating cylinder itself. This blocking action prevents the unwanted swingback of the barrier elements even in the case of an outer force being exerted, either vertically or horizontally.

In an embodiment of the invention braces can emanate from the lateral surfaces at right angles and extend in the direction of the neighbouring post, thus guaranteeing that bicycles for example cannot pass through the barrier elements. However irrespective of this characteristic it must be mentioned that the area between the pivoted barrier elements is not covered over, the resulting opening thus representing a further obstacle.

Finally it must be emphasised that the interchangeable unit preferably comprises three barrier elements; in the case of wider highway area having to be protected several units can be set in a row.

In an embodiment of the invention it is suggested that the barrier device comprises at least two stages; one stage being formed by the barrier elements and the other stage being forced by at least one ramp-like element which can be swung out of the roadway and which is set at a distance to and behind the barrier elements in the driving direction.

The following advantage is achieved by the dual-stage system. Should a vehicle sit on top of the barrier elements while they are swung out of the roadway surface, said vehicles cannot tip forward, since the front end of the vehicle would then be held by the ramp-like functioning element at a distance to the roadway surface, thus preventing the load from being tipped forward and out. Consequently the barrier device according to the invention is particularly suitable for use in military or diplomatic installations, which have to be effectively protected, for example against bomb attacks.

In an embodiment of the invention the element is preferably arranged in the centre of the roadway, so that it is unnecessary to place several side by side. Of course it is also possible to insert the elements forming the second stage into the roadway staggered to each other, thus forming an effective barrier for vehicles of varying sizes.

The ramp-like functioning element can be formed by at least two U-shaped iron sections in the longitudinal direction of the roadway, on which a steel plate is arranged which is flush with the roadway surface.

The element, which can be pivoted out of the roadway surface, combines preferably with a hydraulic cylinder. It is furthermore proposed that the edge areas of the roadway surface encompassing the element are also made of steel plates, resulting in ease of maintenance.

BRIEF DESCRIPTION OF THE DRAWINGS

Further details, details, advantages and characteristics of the invention are not only contained in the claims, from which the characteristics can be drawn—singly or in combination—, but also from the following description of a preferred embodiment represented in the drawing.

The figures show:

FIG. 4: a detailed representation of a barrier ramp FIG. 5: a top view of the barrier ramp according to FIG. 4

FIG. 6: a sectional representation along the line AA in FIG. 5

DETAILED DESCRIPTION OF THE PREFERRED EMBODIMENTS

Figure 1:
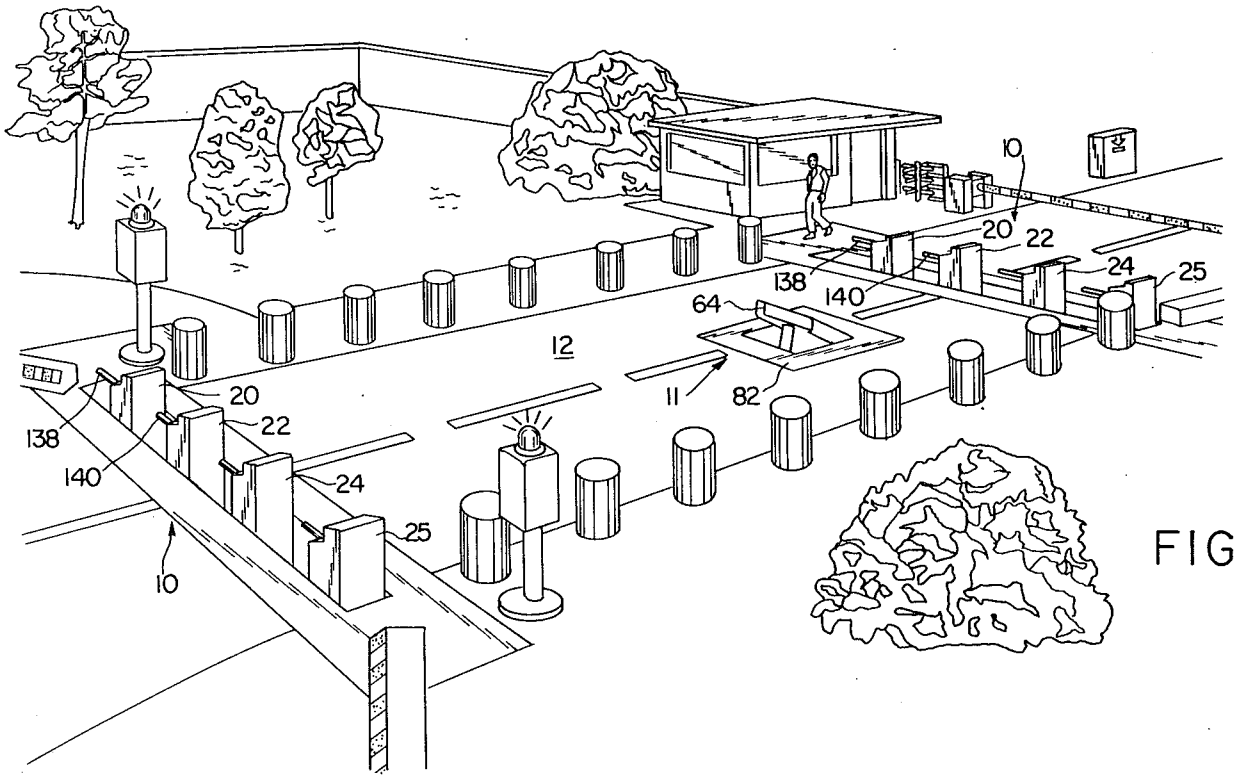
FIG. 1: a principle representation of arrangements of barrier devices

FIG. 1 represents a multi-staged barrier arrangement for the blocking of a roadway (12) by choice in order to ensure that unauthorised or violent access to the highway equipped with the barrier arrangement is prevented. In the preferred embodiment the barrier arrangement comprises two barrier devices (10) and (11), of varying design which are set into the highway surface flush with it and at a distance to each other or can be swung out of the highway surface.

The barrier arrangement according to the invention ensures that vehicles which may have overcome the outer barrier device (10) cannot tip forward onto the roadway (12), but are rather held in an upright position by the second barrier device (11), so that object for example on the loading surface of a vehicle cannot be swung in the direction of the area being protected.

Detailed representations of the barrier devices (10) and (11) are contained in FIGS. 2 to 7, which are to be described in more detail as follows.

Figure 2:
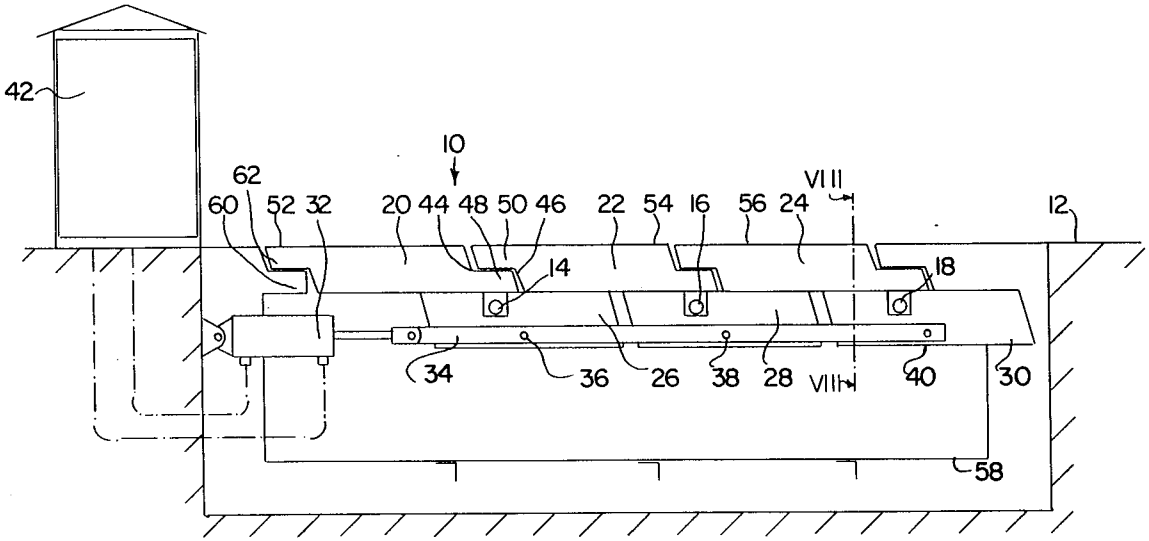
FIG. 2: a detailed representation of a barrier device with sunken barrier elements
Figure 3:
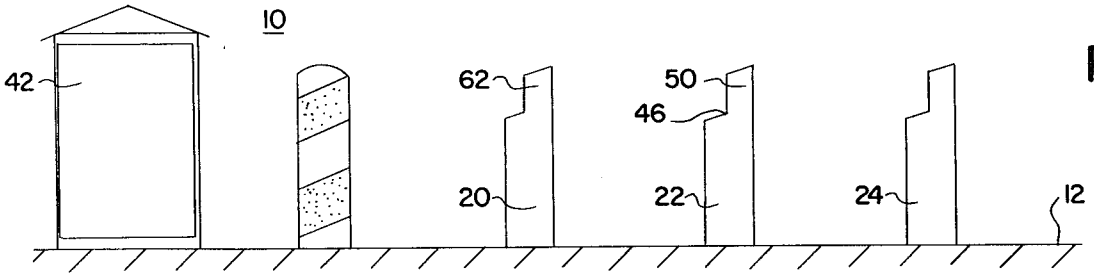
FIG. 3: the barrier device according to FIG. 2 with barrier elements swung out
Figure 7:
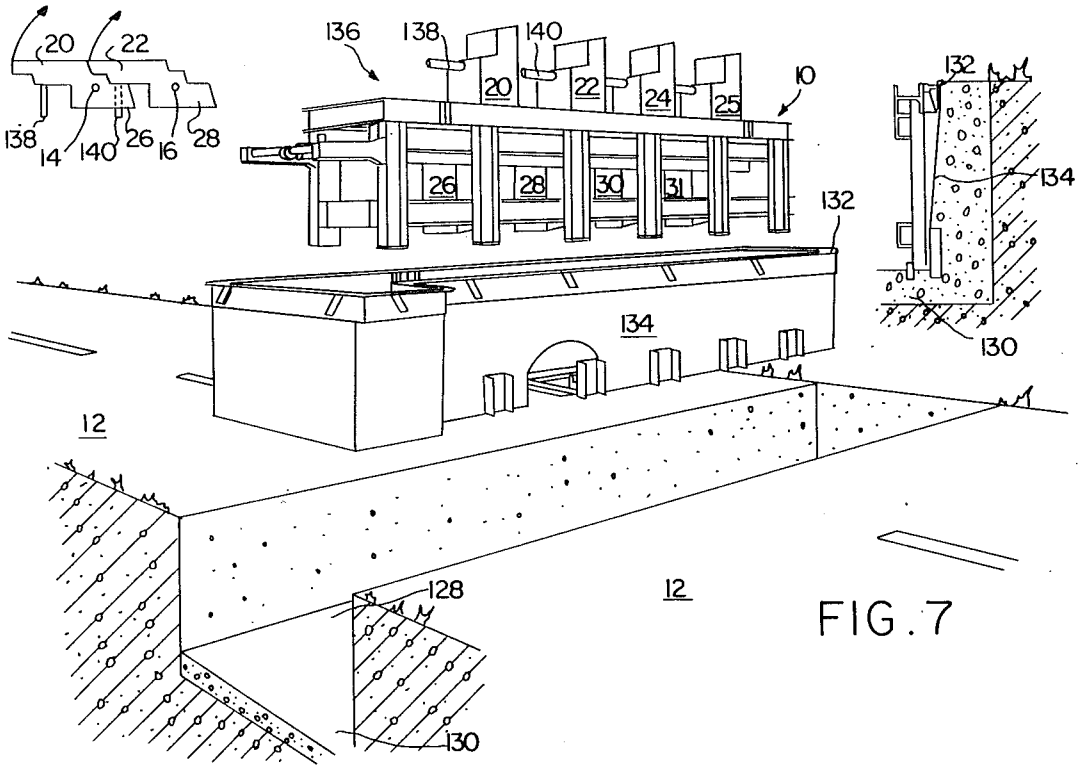
FIG. 7: an enlarged representation of a barrier device according to FIG. 1.

In the embodiment according to FIGS. 2, 3 and 7 the first barrier device comprises three blocking elements (20, 22, 24), which each pivot around an axle (14, 16, or 18). The axles (14, 16, 18) extend in the longitudinal direction of the highway (12), so that the blocking elements (20, 22, 24), which are posts, can be swung out of the highway (12) vertical to the normal travelling direction. Each post (20, 22, 24) has a counter-element or counter-weight (26, 28, 30) coordinating with it, which is arranged below ground independant of the position of the posts (20, 22, 24). The swing axles (14, 16, 18) extending in the area of the counter-elements (26, 28, 30) are moreover preferably arranged in the area of the centre of gravity of the masses assembled by the elements (20, 26 or resp. 22, 28 or resp. 24, 30). This facilitates the pivotability of the barrier elements (20, 22, 24) with the counter-elements (26, 28, 30). Therefore pivoting results via a rod such as combining rods (34) which emanate from a motor organ such as a hydraulic cylinder (32); rod or rods being linked to the counter-elements (26, 28, 30) in the points (36, 38, 40) and if necessary sectioned. Operation of the hydraulic cylinder (32) takes places preferably from a metal cabin (42), so that when necessary the blocking elements (20, 22, 24) are swung out of the highway (12) or sunk into it.

The posts (20, 22, 24) are in the area of the swing axles (14, 46,18) and are arranged in an overlapping manner above the said swing axles and support each other, resulting in a completely simple but yet statically sound construction.

To achieve the overlapping the coordinated ends (48, 50)—represented in an exemplary fashion on the posts (20) and (22)—have graduated recesses (44 or 46) which complete each other. This permits the ends (48, 50) to lie on top of each other above the axle (36) without the lateral areas (52, 54, 56) of the barrier posts (20, 22, 24) which are flush with the highway having to reveal unevenness. The front end (62) of a barrier element (20) not interacting with a neighbouring post is supported on a cement protrusion (60), thus achieving sufficient stability.

Figure 8:
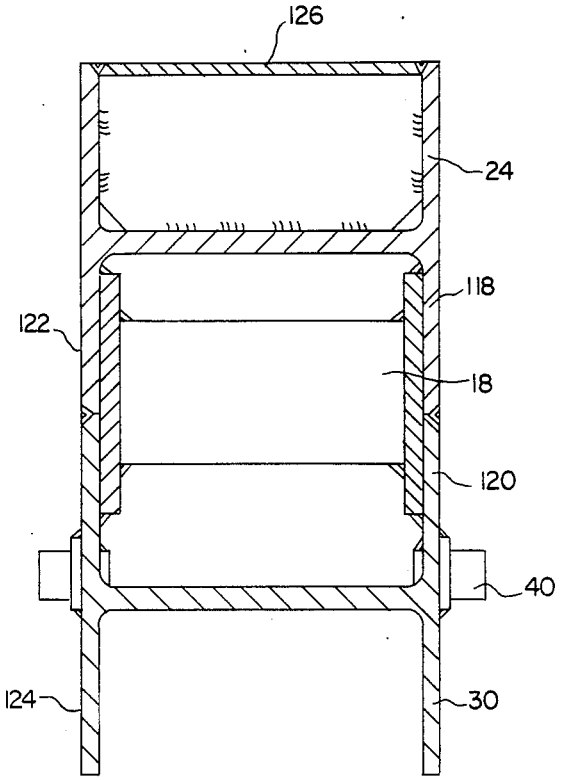
FIG. 8: a sectional representation along the line VIII—VIII in FIG. 2.

FIG. 8 shows a sectional representation of the barrier element (24) according to the invention with the counter-element (30), in order to clarify their construction.

The barrier element (24) as well as the counter-element (30) consist of a double-T girder whose flanges (118 and 120 or 122 and 124) are welded together. The flanges (118 and 122) are welded on the exterior with flat steels (only flat steel (126) is represented), thus providing a post enclosed on all sides as a barrier element (24). Furthermore reinforcing ribs can be welded inside the chamber formed by the flanges (118 and 122) and the flat steels to provide the barrier element with increased rigidity.

Of course the chamber of the relevant double-T girders is also closed off by flat steels in the area of the free outer ends of the barrier elements. Furthermore it should be noted that the protrusions provided in the free ends (50) cause material bouncing against the barrier posts to be penetrated in a cutting fashion.

FIG. 7 represents the barrier device (10) according to the invention in a blown-up representation to clarify their insertion into and extraction from the roadway.

First of all a pit (128) is excavated out of the highway (12), on the floor of which (130) a cement floor is laid. Then a frame (132) is inserted into it with a dead mould (134) which can be made of sheet metal, so that finally the cavity between the dead mould (134) and the pit can be filled with cement. This provides a frame for the unit (136) which comprises the barrier elements (20, 22, 24 and 25) withthe counter-elements (26, 28, 30 and 31), the combining rods pivoting these as well as the drive equipment in the form of a hydraulic cylinder (in each case not represented). If this unit (136) is set on the frame (132) and screwed to it, the hydraulic cylinder can be connected with driving fluid, thus rendering the barrier device operational. Should for example one of the barrier elements become inoperational due to a defect or maintenance work the unit (136) simply has to be disconnected from the frame (132) and finally covering elements such as ramps have to be laid on the frame so that the roadway (12) can continue to be used. This guarantees that even in the case of a barrier device (10) not operating correctly the highway can be quickly cleared again for vehicles; an advantage not contained in the corresponding barrier devices to be drawn from the state of the art.

The barrier elements (20, 22) represented alone at the top left in FIG. 7 with counter-elements (26 and 28) as well as pivot axles (14 and 16) have pipe support-shaped protrusions (138 and 140) running at right angles to their longitudinal axes. These block the area between the barrier elements standing adjacent, so that the barrier element (10) also forms an effective barrier blocking access for bicycles.

The unit (136) provided in FIG. 2 with reference no. (58) and as underground assembley unit has preferably a hot-dip galvanised support construction out of U and double-T iron which is correspondingly suited to the strains. Here the construction is fundamentally chosen so that each barrier post withstands strains of 100 tons at a vehicle speed of 30 km per hour without the pivotability being in any way influenced. The double-T girders of the barrier elements themselves have shaft lengths of preferably 300 mm, whereby the height of the area rising above the highway surface is approx. 650 mm. This height is sufficient to reach at least the axle area of almost all vehicles, so that in the case of a vehicle hitting the barrier the vehicle becomes inoperable.

The passable lateral areas (52, 54, 56) of the blocking posts (20, 22, 24) can be provided with a checkered plate which is not represented.

Control for the hydraulic cylinder (32) and the pressure lay-out is chosen so that in the case of an electricity cut control can be maintained by a 24V battery, whereby operation of the barrier elements (20, 22, 24) several times is guaranteed by an energy storage unit. Furthermore in an emergency the barrier elements (20, 22, 24) can be sunk by means of a hand pump. Consequently the barrier device (10) can be designated as being self-sufficient.

In FIGS. 4 to 6 the second barrier device (11) is represented in detail, said device comprising a ramp-like functioning element (64) which can be swung out of the roadway (12) and which can be operated by a hydraulic cylinder (68) arranged in a shaft (66). In the preferred embodiment the element (64) consists of a steel plate (70) which is held by two U-shaped steel sections (72 or 74). The longitudinal axes of the U-shaped steel sections (72 and 74) extends in the longitudinal direction of the roadway. The element (64), which when sunk into the roadway is flush with the roadway (12), can be pivoted around an axle (76), whereby a shaft (78) necessary for this passes through the U-shaped steel sections (72) and (74). At a distance to the shaft (78) the hydraulic cylinder (68) engages into a shaft (80) also extending between the U-shaped steel sections (72 and 74) in order to thus swing the element (64) out of the highway surface or to render the element flush with it to the required extent.

As in particular FIG. 1 clarifies, the element (64) is designed ramp-like to the first barrier stage (10), i.e. the pivoting axle (76) lies nearer to the first stage than the shaft (80). The edge (82) of the roadway (12) enclosing the element (64) is also preferably made of sheet metal to provide ease of maintenance.

As FIG. 1 also shows, the element (64) is preferably arranged in the middle of the roadway (12) so that effective protection is guaranteed against vehicles which at least have partly overcome the first barrier (10), ie. are sitting on top of it and are in danger of tipping forwards. In order to prevent all normal vehicles which could possibly overcome the first barrier stage from tipping forwards it is sufficient if the element (64) is 400 mm. wide and 1200 mm long, whereby the swing area of the highway surface should be 600 mm.

I claim:

1. A barrier device for temporary blocking of a roadway having a surface to prevent passage of a vehicle through said device comprising (a) a plurality of barrier elements located sufficiently close to one another so that said vehicle cannot pass therebetween, said barrier elements having an aligned position, in which said barrier elements are substantially flush with said surface, and an erect position, in which said barrier elements extend substantially vertically from said surface;

(b) each of said barrier elements being pivotable about an axis substantially parallel to a direction of movement on said roadway;

(c) each of said barrier elements pivotably mounted on a counter element, at a point below said surface, said counter element being substantially below said surface whereby a plurality of pivots is formed, (d) said pivots linked to a rod adapted for reciprocal movement substantially parallel to said surface and perpendicular to said direction whereby, when said rod is in a first position, said barrier elements are in said aligned position and, wherein said rod is in a second position, said barrier elements are in said erect position;

(e) each of said barrier elements having, at each end thereof, a first protruding portion and a second complementary recessed portion;

(f) said first protruding portion of each of said barrier elements, whcn said barrier elements are in said aligned position, overlying and resting upon said second recessed portion of an adjacent barrier element thereto directly above the axis of said adjacent barrier;

whereby said vehicle can be blocked when said barrier elements are in said erect position and permitted to pass when said barrier elements are in said aligned position.

2. The device of claim 1 wherein said barrier elements each comprise a double-T girder.

3. The device of claim 1 wherein said counter-element is a double-T girder.

4. The device of claim 1 wherein said first portion comprises an area substantially parallel to said adjacent barrier element and a flat extending from said area to an exterior of said barrier element, an angle between said area and said flat being obtuse.

5. The device of claim 1 wherein said axis is substantially at a center of gravity of each of said barrier elements and said counter element.

6. The device of claim 1 wherein said barrier elements are provided with ridges or checkered plates on the parts thereof over which said vehicle passes when said barrier elements are in said aligned position.

7. The device of claim 1 wherein each of said pivots comprises an axle extending through said counter element, said barrier being pivotally mounted on said axle and said axle being mounted on said rod.

8. The device of claim 7 wherein said axle is substantially at a center of gravity of each of said barrier elements and said counter element.

9. The device of claim 1 wherein each said barrier element is adapted to damage said vehicle in the event of a crash therebetween.

10. The device of claim 9 wherein said rod is reciprocated by a power source through a drive mechanism.

11. The device of claim 10 wherein said mechanism comprises a hydrualic cylinder.

12. The device of claim 10 wherein said barrier elements, said counter elements, and said rod are a unit which is adapted to be inserted into a frame, said frame having a dead mold whereby said unit and said frame can be replacably inserted into a pit in said roadway.

13. The device of claim 12 wherin said drive mechanism is adapted to be replaceably set in said frame with said unit.

14. The device of claim 12 wherein there is also provided a ramp-like element adapted to be moved between a flush position, wherein said ramp-like element is substantially in the plane of said surface, and an extended position, wherein said ramp-like element extends above said surface, said ramp-like element located behind said barrier elements in relation to said passage.

15. The device of claim 9 wherein each of said barrier elements comprises a bar element extending substantially perpendicularly to both the longitudinal axis of each of said barrier elements and said direction of movement.

16. The device of claim 1 wherein there is also provided a ramp-like element adapted to be moved between a flush position, wherein said ramp-like element is substantially in the plane of said surface, and an extended position, wherein said ramp-like element extends above said surface, said ramp-like element located behind said barrier elements in relation to said passage.

17. The device of claim 16 wherein said ramp-like element is substantially in the middle of said roadway.

18. The device of claim 16 wherein said ramp-like element comprises two U-shaped sections extending in said direction on which a plate is located which is substantially level with said surface when said ramp-like element is in said flush position.

19. The device of claim 16 wherein said ramp-like element is actuated by a hydraulic cylinder in a hole below said surface.

20. The device of claim 16 wherein said roadway around said ramp-like element is constructed of metal plates

* * * * *